US006631535B2

(12) United States Patent
Sergyeyenko et al.

(10) Patent No.: US 6,631,535 B2
(45) Date of Patent: Oct. 14, 2003

(54) DUAL ON/OFF SWITCH ACTUATION FOR A POWER HEAD OF AN UPRIGHT VACUUM CLEANER

(75) Inventors: Oleksiy P. Sergyeyenko, Brockville (CA); Murray D. Hunter, Kingston (CA); David M. Shaver, Brockville (CA); Jacob R. Prosper, Brockville (CA); Thomas Trevor Bludis, Cockeysville, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/886,962

(22) Filed: Jun. 21, 2001

(65) Prior Publication Data

US 2002/0194696 A1 Dec. 26, 2002

(51) Int. Cl.[7] ..... A47L 5/00; A47L 9/00; A47L 9/132

(52) U.S. Cl. ..... 15/410; 15/339; 15/412; 15/DIG. 10

(58) Field of Search ..... 15/339, 410, 412, 15/DIG. 10; 200/331, 332.2, 547

(56) References Cited

U.S. PATENT DOCUMENTS 1,282,548 A * 10/1918 De Reamer ..... 15/412
2,842,788 A * 7/1958 Rench et al. ..... 15/23
3,676,890 A * 7/1972 Dyer ..... 15/339
4,421,964 A * 12/1983 Buchtel ..... 15/344
4,733,433 A 3/1988 Simm et al.
5,664,285 A 9/1997 Melito et al.
5,671,499 A 9/1997 Melito et al.
5,699,586 A 12/1997 Melito et al.
5,850,667 A * 12/1998 Orsini ..... 15/339
5,906,520 A 5/1999 Frinker et al.
5,983,444 A 11/1999 Jacobs et al.
5,991,970 A * 11/1999 Jailor et al. ..... 15/339
6,012,200 A 1/2000 Murphy et al.

* cited by examiner

*Primary Examiner*—Terrence R. Till
(74) *Attorney, Agent, or Firm*—Harness, Dickey & Pierce, P.L.C.

(57) ABSTRACT

A vacuum cleaner system having an electric powerhead with a first switch actuator component which can be actuated with a user's thumb, to turn on and off the powerhead, and a second switch actuator component which can be actuated with the user's foot, to also turn on and off the powerhead. The first switch actuator component is used when the powerhead is being used in a handheld cleaning mode. The second switch actuator component is used when the powerhead is being used in a floor cleaning mode along with an upright handle attached to the powerhead. An anti-tip over lockout system is incorporated for preventing the powerhead from being accidentally turned on when it is being held in an upside down orientation, such as during cleaning of a beater brush thereof.

22 Claims, 4 Drawing Sheets

DUAL ON/OFF SWITCH ACTUATION FOR A POWER HEAD OF AN UPRIGHT VACUUM CLEANER

FIELD OF THE INVENTION

The present invention relates to vacuum cleaner systems, and more particularly to an upright vacuum cleaner system having an independently usable powerhead component, and wherein the powerhead component includes an On/Off switch which can be actuated from either a thumb actuator button or a foot operated actuator component.

BACKGROUND OF THE INVENTION

Vacuum cleaner systems, and particularly upright vacuum cleaner systems, are used in a wide variety of cleaning applications. Such upright vacuum cleaner systems typically include an upright handle portion and some form of base or "powerhead" unit. The base unit typically includes a suction airflow opening on its underside through which a vacuum airflow is generated. Typically, the upright handle is not removable from the base unit and the base unit is not intended to be used without its upright handle. As such, there is typically only a single On/Off switch located on the base unit which is intended to be actuated with a user's foot.

With a vacuum cleaner system having an independently usable electric powerhead component, it would be undesirable to include only a single switch actuator. Having only a single switch actuator for turning on and off the electric powerhead would require the user to use that switch actuator to turn on and off the powerhead regardless of whether the powerhead is being used with its upright handle in an upright cleaning mode, or as an independent, hand-held cleaning tool. Thus, the use of a single switch actuator would require the user to engage the same switch actuator with one or more fingers of a hand, when the vacuum cleaner is used in a hand-held cleaning mode, or with a portion of one's foot, when the electric powerhead is being operated in an upright cleaning mode.

It would therefore be highly desirable to provide an electric powerhead that incorporates separate switch actuator elements, one adapted to be used with the fingers of a hand while the powerhead is being used in a handheld cleaning mode, and a second switch actuator element which is adapted to be engaged with a foot of the user when the powerhead is being used in an upright cleaning mode with an upright handle attached to the powerhead. It would also be desirable to provide such a vacuum cleaner system in which the use of two switch actuator components does not significantly complicate the construction of the electric powerhead or otherwise interfere with the vacuum airflow generated through the powerhead during use.

SUMMARY OF THE INVENTION

The present invention is directed to a vacuum cleaner system having an electric powerhead which may be used in a hand-held cleaning mode or in an upright cleaning mode with a removable upright handle, wherein dual switch actuator components are provided on the powerhead. The dual switch actuator components allow the user to turn an electric motor of the powerhead on and off via a thumb or finger of the user's hand when the powerhead is being used in a hand-held cleaning mode, and allow the electric motor to be turned on and off via a separate foot actuator component when the vacuum cleaner system is being used in an upright cleaning mode.

In one preferred embodiment the electric powerhead includes a handle portion for allowing the user to easily grasp and manipulate the powerhead when using it in the hand-held cleaning mode. A first switch actuator component is disposed at one end of the handle and a second switch actuator component is disposed at the opposite end of the handle. A coupling arm extends within the handle from the first switch actuator component into contact with the second switch actuator component. An electric on/off switch is disposed under the first switch actuator component so that a user may turn on and off the On/Off switch by selectively depressing the first switch actuator component.

In one preferred embodiment the coupling arm is pivotally supported at an approximate midpoint thereof at a point within the handle of the powerhead. The coupling arm can thus pivot in response to movement of the second switch actuator component. Thus, when the second switch actuator component is depressed with the user's foot, this causes pivoting of the coupling arm and the opposite end thereof to depress the electric switch mounted within the housing, thus turning the motor on or off. Thus, the use of the second switch actuator component does not interfere with or impede use of the first switch actuator and vise versa.

The use of two separate switch actuator components allows the user to use one switch actuator component when the electric powerhead is being used in a hand-held cleaning mode, and where the switch is conveniently placed for finger or thumb actuation, and a second switch actuator component which is conveniently placed for foot actuation when the electric powerhead is being used in an upright cleaning mode with its associated upright handle. Since the coupling arm extends through the interior of a handle of the electric powerhead, it does not interfere with the suction airflow generated within the powerhead, nor does it complicate the placement of the electric motor within the powerhead.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
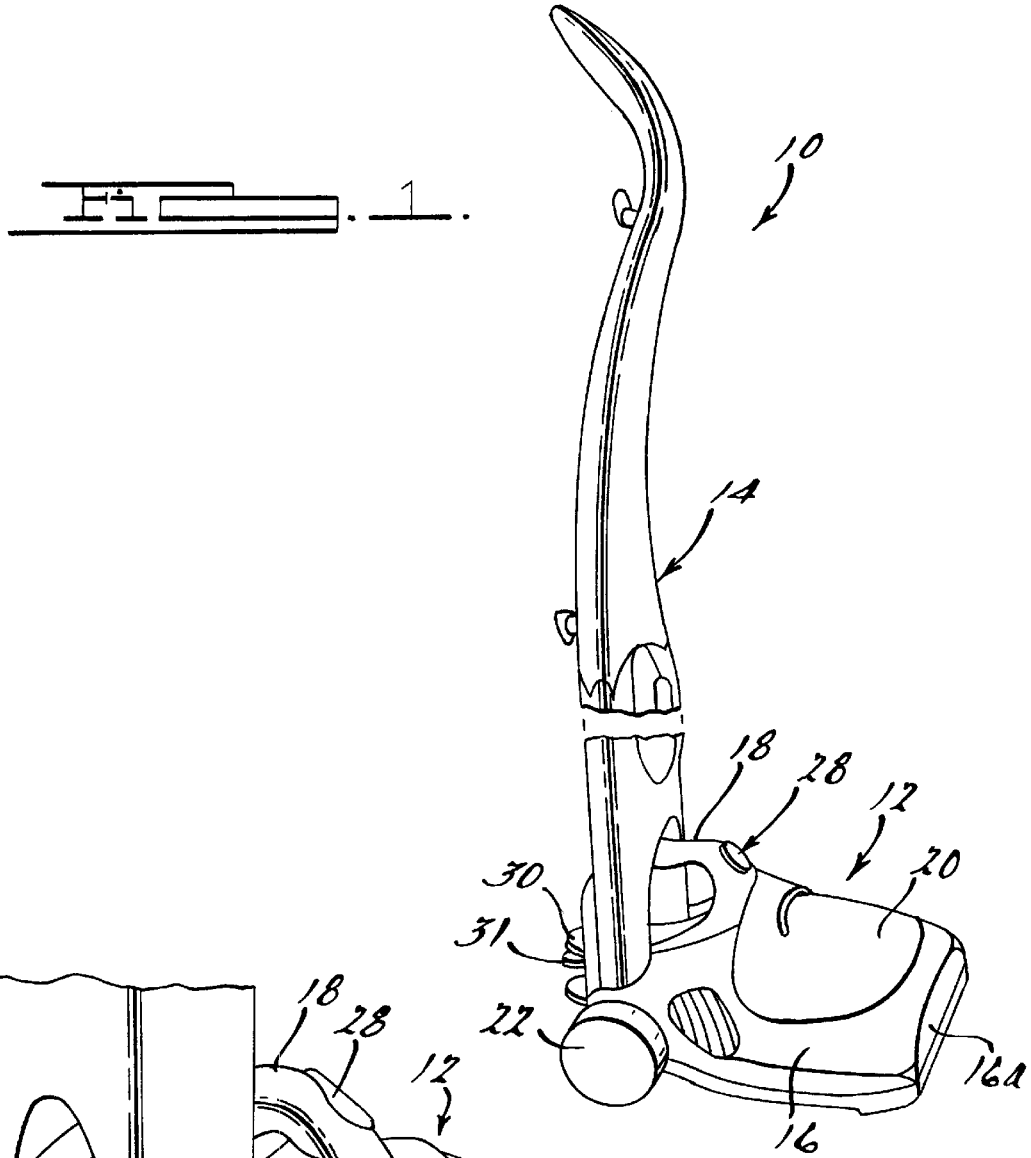
FIG. 1 is a perspective view of an upright vacuum cleaner incorporating a dual On/Off switch actuator system in accordance with a preferred embodiment of the present invention.
Figure 2:
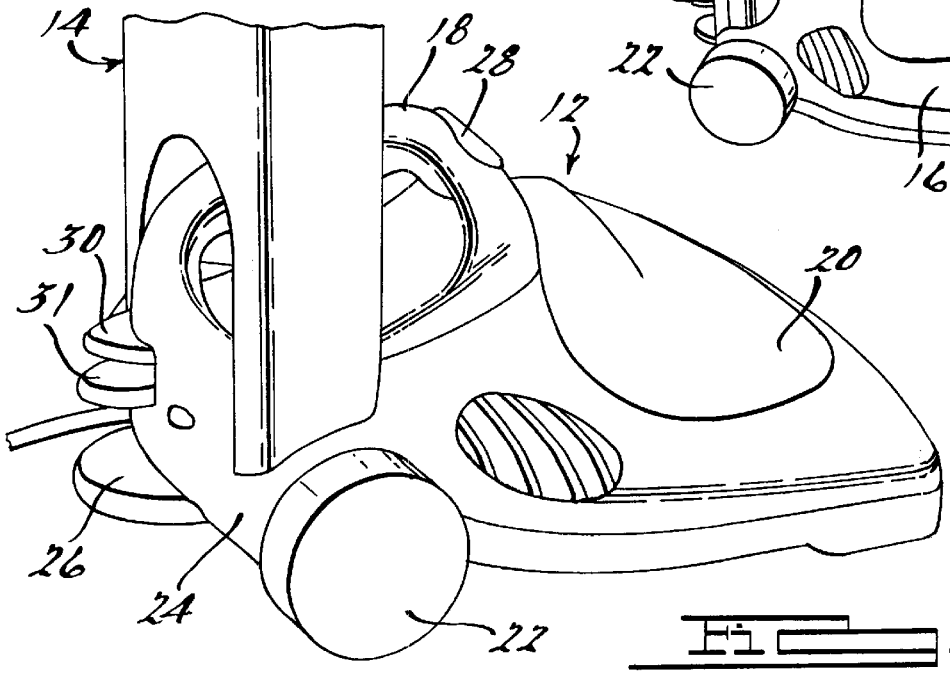
FIG. 2 is an enlarged view of the electric powerhead of the vacuum cleaner of FIG. 1.

Referring to FIGS. 1 and 2, there is shown a vacuum cleaner system 10 in accordance with a preferred embodiment of the present invention. The vacuum cleaner system 10 includes an electric powerhead 12 and an upright handle 14 which can be detached from the powerhead. When the handle 14 is attached to the powerhead 12, the vacuum cleaner system 10 can be used in an upright cleaning mode whereby the handle 14 is used to steer and propel the powerhead 12 over a surface being cleaned. When the handle 14 is detached from the powerhead 12, the powerhead can be used as an independent component in a hand-held cleaning mode to clean stairs, inside closets, and other areas where it is inconvenient and/or practical to manipulate the powerhead 12 via the handle 14.

The powerhead 12 includes a housing 16 having an integrally formed handle 18. The housing 16 also includes a removable dirt cup container 20 for containing dust and dirt debris which is filtered from the vacuum airflow drawn in through the powerhead 12. A conventional motor driven beater brush (not visible) is disposed within a forward portion 16*a* of the housing 16. The housing 16 is also supported via a pair of oversized wheels 22 (only one being visible) disposed at a rear area 24 of the housing. A foot operated latch switch 26 allows the user to detach the upright handle 14 from the powerhead 12.

Figure 6:
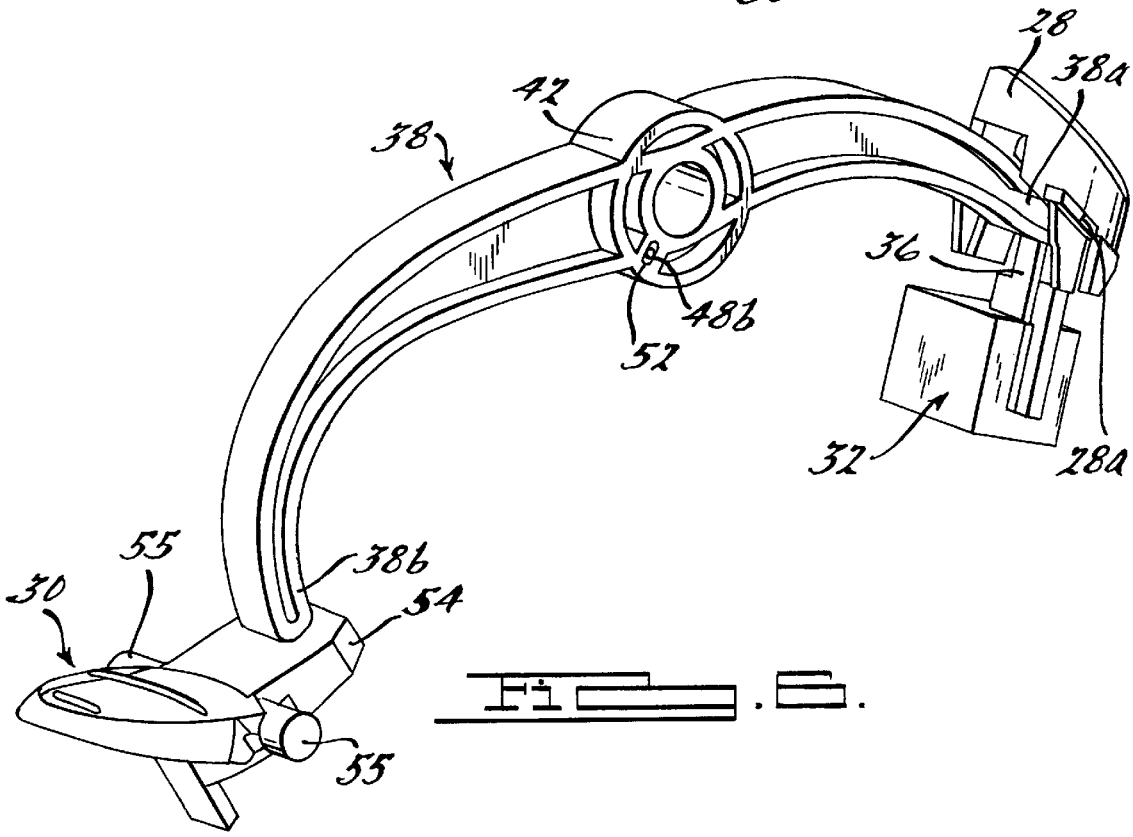
FIG. 6 is a perspective view of the rear (i.e. foot) actuator component, the coupling arm, the On/Off switch and front (i.e. thumb) actuator component.

The handle 18 of the powerhead 12 further includes a first, thumb actuated, switch actuator component 28 at a forward portion of the handle and a second, foot operated, switch actuator component 30 disposed at a rear portion of the handle 18, both being disposed adjacent an electric fan motor 34. The second switch actuator component 30 is also shown in FIG. 6. When the vacuum cleaner system 10 is being used in a floor cleaning mode with its upright handle 14, the fan motor 34 of the powerhead 12 can be powered on and off by the user actuating the second switch actuator component 30 with the users foot. A stop member 31 limits the downward travel of the switch actuator component 30. When the powerhead 12 is being used in its hand-held cleaning mode (i.e., without the handle 14), the thumb of the user can be used to actuate the first switch actuator component 28 to turn on and off the fan motor.

Figure 3:
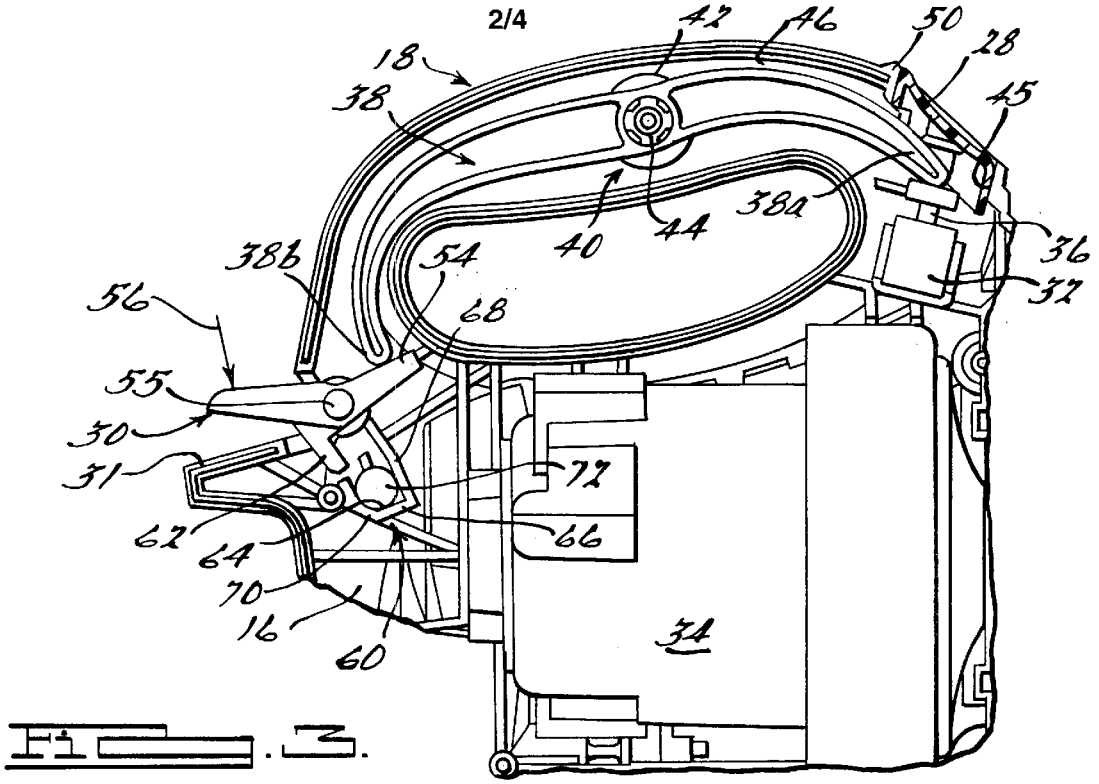
FIG. 3 is a cross-sectional side view of a portion of the electric powerhead showing in detail the components of the dual On/Off switch actuation system, with both switch actuators in the off position.

Referring now to FIG. 3, the powerhead 12 can be seen to include an electric switch 32 which is disposed toward the forward end of the handle 18, the switch 32 is electrically coupled to the electric fan motor 34 for turning on and off the motor 34. The switch 32 includes a plunger 36 which moves linearly up and down to turn on and off the switch. The first switch actuator component 28 is supported within the handle 18 adjacent to a coupling member in the form of a curved, elongated coupling arm 38 (also shown in FIG. 6). The coupling arm 18 extends through a hollow interior area 4 of the handle 38.

Figure 7:
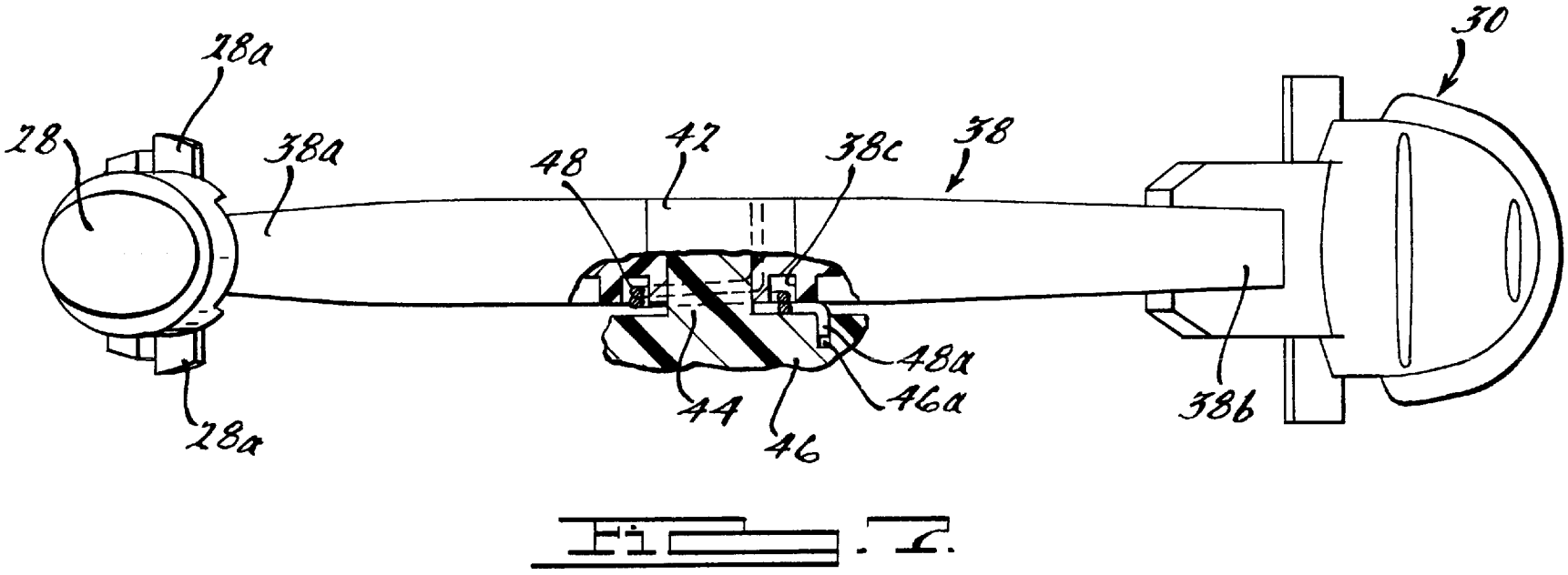
FIG. 7 is a plan view of the coupling arm illustrating its coupling to the handle.

With reference to FIGS. 3 and 7, the coupling arm 38 is pivotally supported at a hub (i.e., midpoint) 42 thereof on a mounting post 44 formed on an interior wall portion 46 of handle 18. The switch actuator component 28 includes a pair of arm portions 28*a* that serve to retain the component within handle 18. Since the handle 18 is of a two-piece clamshell-like construction, the switch actuator component 28 can be placed between the two halves of the handle 18 and it will be captured in an opening 45 in the handle. The switch actuator component 28 rests on a forward end 38*a* of the coupling arm 38, which in turn urges the switch plunger 36 down to turn on and off the fan motor 34. A torsion spring 48 is disposed on the mounting post 44 and extends into a recess 38*c* of the coupling arm 38. The torsion spring 48 has one end 48*a* engaged within a notch 46*a* in the wall portion 46 and the other end 48*b* engaged within a notch 52 in the hub 42 (FIG. 6). The torsion spring 48 biases the forward end 38*a* of the coupling arm 38 upwardly such that the first switch actuator component 28 is maintained within a circumferential rib 50 when the switch actuator component 28 is not being depressed by the user's thumb. This position also maintains a distal end 38*b* of the coupling arm 38 in contact with an arm portion 54 of the second switch actuator component 30. The switch 32 also includes an internal spring (not shown) which helps to bias the forward end 38*a* of the coupling arm 38 upwardly.

With further reference to FIGS. 3 and 6, the second switch actuator component 30 is also pivotally supported within the housing 16 by a pair of mounting arms 55 formed so as to extend transversely of the arm portion 54 on the interior wall 46. A downward force along arrow 56 causes the arm portion 54 to move counterclockwise, thus causing a pivoting movement of the coupling arm 38. This causes the first switch actuator component 28 to depress the plunger 36 of the switch 32. Thus, the plunger 36 can be actuated either by pressing switch actuator component 28 or switch actuator component 30. The second switch actuator component 30 is shown fully depressed in FIG. 4.

Figure 4:
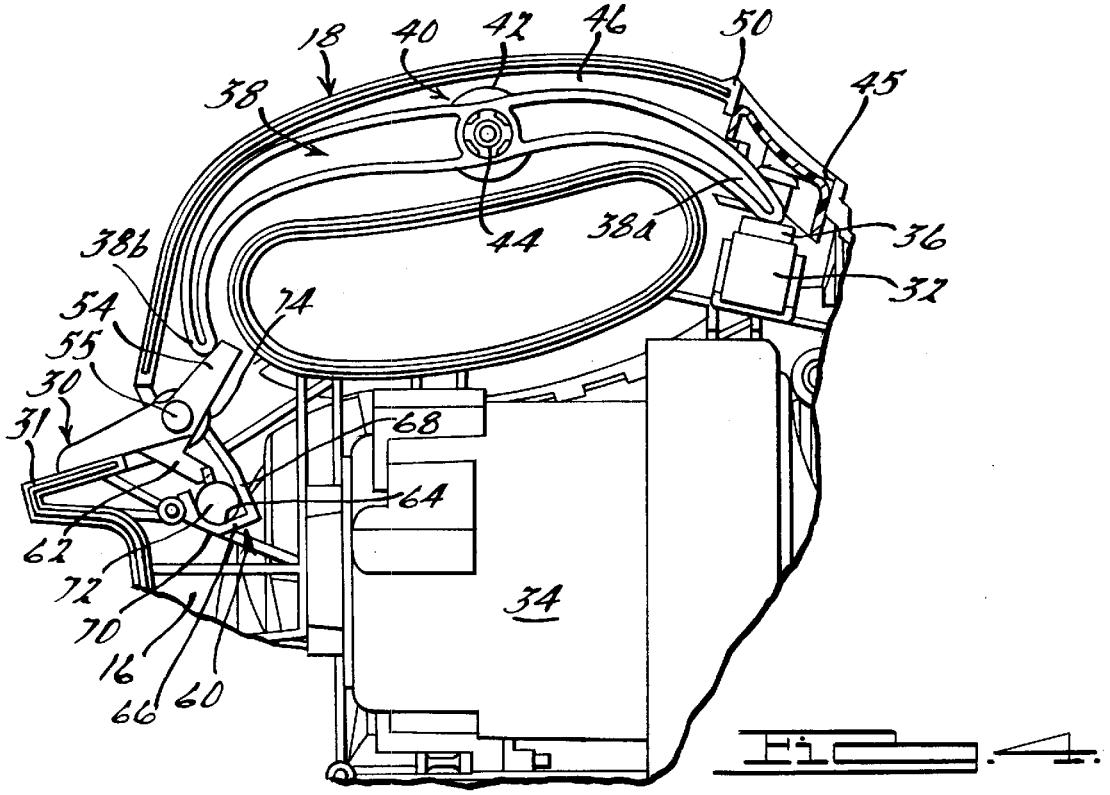
FIG. 4 is a view of the switch actuators of FIG. 3 but with the rear switch actuator depressed.
Figure 5:
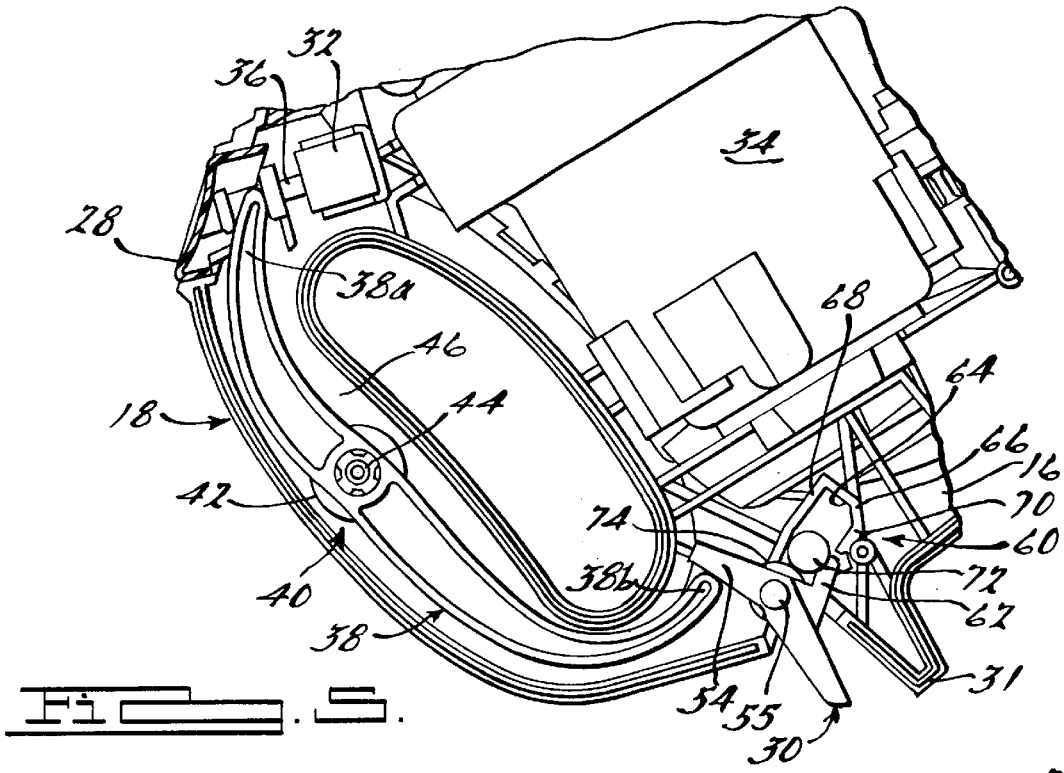
FIG. 5 is a view of the switch actuators of FIG. 3 but with the electric powerhead turned upside down, illustrating how the anti-tip over lockout system prevents the rear actuator switch from being accidentally engaged by a user.

Another important feature of the vacuum cleaner system 10 is the inclusion of an anti-tipover mechanism, generally denoted by reference numeral 60 in FIGS. 3, 4 and 5. This mechanism 60 prevents the powerhead 12 from being accidentally turned on by the user inadvertently depressing the second switch actuator 30 when the powerhead is being held in an upside down orientation as shown in FIG. 5. With specific reference to FIGS. 3 and 4, to implement the anti-tipover mechanism 60, the second switch actuator component 30 is provided with a leg portion 62 and the housing 16 is provided with a recess 64 formed in part by a bottom wall portion 66 and wall portions 68 and 70. Wall portions 66, 68 and 70 help to form the recess 64, which is essentially a "pocket" within which an independent member 72, illustrated as a ball bearing, is disposed. The second switch actuator component 30 is disposed over the open end of the recess 64 to prevent the ball bearing 72 from falling completely out of the recess 64 when the powerhead 12 is turned upside down. It will be appreciated that the powerhead 12 may need to be turned upside down, such as when cleaning the beater brush thereof, and it is important that the user is not able to accidentally turn on the powerhead by inadvertently depressing the second switch actuator component 30.

With reference to FIG. 4, it can be seen that the ball bearing 72 does not interfere with pivotal movement of the second switch actuator component 30 when the powerhead 12 is in its upright orientation. In this orientation, the leg 62 of the second switch actuator component 30 is free to clear the ball bearing 72 when the switch actuator component 30 is depressed. Referring to FIG. 5, when the powerhead 12 is turned in an upside down orientation, the ball bearing 72 falls into contact with a wall portion 74 of the housing 16. The ball bearing 72 now is in a position to interfere with the leg 62 of the second switch actuator component 30, thus preventing switch actuator component 30 from being depressed.

The dual switch actuator components 28 and 30 of the present invention, being disposed within or adjacent to the handle 18, do not interfere with the suction airflow through the powerhead 12, nor with the placement of the motor 34 within the powerhead. The dual switch actuation system further does not significantly complicate the assembly of the powerhead 12 nor add to its overall weight or significantly increase its cost. Importantly, switch actuator components 28 and 30, together with coupling arm 38, enable the powerhead 12 to be conveniently turned on and off by either a conveniently placed thumb or finger accessible component (i.e., switch actuator component 28) or via a foot actuated member (i.e., switch actuator component 30) which is easily accessible by the user with his/her foot when the vacuum cleaner system 10 is being used in its upright cleaning mode.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A tool comprising:

a housing having a graspable portion;

a switch disposed within said housing for activating an element of said tool;

a motor for driving a working element;

a first switch actuator component disposed on said housing and adjacent said motor, and adapted to be engaged with a hand of a user and operably coupled to said switch to activate said motor; and a second switch actuator component disposed remotely from said first switch actuator component on said housing, and adjacent said motor, and operably coupled to said switch, and adapted to be engaged by a foot of said user for activating said switch, to thereby enable said user to control said motor via either of said first and second switch actuator components.

2. A vacuum cleaner system comprising:

a powerhead having an electric motor with a fan for generating a vacuum airflow and adapted to be used in either a handheld cleaning mode or an upright cleaning mode;

a switch for turning on and off said electric motor;

a first switch actuator component adapted to be engaged by a finger or thumb of a user, and operably coupled to said switch, to thereby allow said user to turn on and off said motor with said finger or thumb;

a second switch actuator component disposed remotely from said first switch actuator component, and operably coupled to said switch, and adapted to be engaged by a foot of said user for turning on and off said electric motor.

3. The vacuum cleaner system of claim 2, wherein:

one of said first and second switch actuator components comprises a coupling arm having a distal portion;

said coupling arm being pivotally mounted at a point along its length to an internal portion of said powerhead;

said distal portion being operationally coupled to the other one of said switch actuator components such that depressing the other one of said switch actuator components causes pivoting of said coupling arm; and wherein said pivoting movement of said coupling arm in turn causes said one of said switch actuator components to turn on and off said switch.

4. The vacuum cleaner system of claim 3, wherein said coupling arm is pivotally mounted at a midpoint thereof to said internal wall portion of said powerhead.

5. The vacuum cleaner system of claim 2, wherein said coupling arm is biased by a spring to maintain said first and second switch actuator components in undepressed positions.

6. The vacuum cleaner system of claim 2, wherein:

said powerhead comprises a housing, said housing including an internal recess having a bottom wall;

an independent member disposed within said recess and moveable freely within said recess, said independent member resting on said bottom wall when said powerhead is in an upright position;

said second switch actuator being disposed adjacent said recess so as to at least partially overlay said recess; and said second switch actuator component including a portion adapted to interfere with said independent member when said powerhead unit is turned in an upside down orientation and said independent member falls away from said bottom wall, to thereby prevent said second switch actuator component from being accidentally depressed and thereby inadvertently turning on said powerhead when said powerhead is being held in said upside down position.

7. A vacuum cleaner system comprising:

powerhead having a housing;

an electric motor with a fan disposed within said housing for generating a vacuum airflow, said powerhead being useable in either a handheld cleaning mode or an upright cleaning mode, said powerhead having a handle for enabling a user to manipulate said powerhead over a surface to be cleaned when said powerhead is used in said handheld cleaning mode;

an electric switch for turning on and off said electric motor;

a first switch actuator component adapted to be engaged by a finger or thumb of a user for actuating said electric switch, to thereby allow said user to turn on and off said electric motor;

a second switch actuator component disposed remotely from said first electric switch actuator component, and at least partially protruding from said housing, and adapted to be engaged by a foot of said user while said vacuum cleaner system is being used in said upright cleaning mode; and a coupling member disposed within said housing and operably associated with said second switch actuator component for turning on and off said electric switch when said second switch actuator is engaged by said user.

8. The vacuum cleaner system of claim 7, wherein said coupling member comprises a curved, elongated coupling arm pivotally mounted within said housing.

9. The vacuum cleaner system of claim 7, wherein said coupling member comprises an elongated coupling arm pivotally supported within said housing at an approximate midpoint thereof.

10. The vacuum cleaner system of claim 7, wherein said coupling member comprises an elongated coupling arm coupled to said first switch actuator component.

11. The vacuum cleaner system of claim 7, wherein said coupling member comprises an elongated coupling arm extending from said first switch actuator component and being pivotally supported within said housing at an approximate midpoint thereof; and wherein a distal portion of said coupling arm is in contact with said second switch actuator component such that depressing said second switch actuator component causes pivotal movement of said coupling arm, whereby said first switch actuator component is caused to engage said electric switch.

12. The vacuum cleaner system of claim 11, wherein said coupling arm is disposed within said handle portion of said powerhead.

13. The vacuum cleaner system of claim 7, wherein;

said housing includes a recess having a bottom wall;

an independent component is disposed within said recess and moveable freely within said recess, said independent component resting on said bottom wall when said powerhead is in a rightside up orientation ready for use; and wherein said independent component falls within said recess into a position interfering with movement of said second switch actuator component when said powerhead is turned into an upside down orientation, thereby preventing said second switch actuator component from being accidentally depressed by said user when said powerhead is being held in said upside down orientation, thereby preventing said electric switch from being inadvertently engaged when said powerhead is being held in said upside down orientation.

14. The vacuum cleaner system of claim 13, wherein:

said independent member comprises a ball;

wherein said second switch actuator component is pivotally mounted within said housing adjacent to said recess and includes a leg portion; and wherein said ball interferes with said leg portion when said powerhead is turned upside down to prevent pivoting movement of said second switch actuator component.

15. The vacuum cleaner system of claim 7, further comprising an upright handle adapted to be detachably coupled to the powerhead.

16. A vacuum cleaner system comprising:

a powerhead having a housing;

an electric motor with a fan disposed within said housing for generating a vacuum airflow, said powerhead being useable in either a handheld cleaning mode or an upright cleaning mode, said powerhead having a handle for enabling a user to manipulate said powerhead over a surface to be cleaned when said powerhead is used in said handheld cleaning mode;

an upright handle secured to said powerhead for assisting a user in using said powerhead in said upright cleaning mode;

a switch for turning on and off said electric motor;

a first switch actuator component protruding from said housing and adapted to be engaged by a finger or thumb of a user for actuating said switch, to thereby allow said user to turn on and off said electric motor;

a second switch actuator component disposed remotely from said first switch actuator component, and adapted to be engaged by a foot of said user while said vacuum cleaner system is being used in said upright cleaning mode;

a coupling member disposed within said housing and operably associated with said second switch actuator component for turning on and off said switch when said second switch actuator is engaged by said user; and an independent member freely moveable within said housing when said powerhead is turned upside down for interfering with movement of said second switch actuator component, to thereby prevent a user from inadvertently turning on said electric motor when said powerhead is being held in an upside down orientation.

17. The vacuum cleaner system of claim 16, wherein said coupling member comprises an elongated coupling arm extending from one of said first and second switch actuator components.

18. The vacuum cleaner system of claim 17, wherein said coupling member is pivotally supported within said housing at an approximate midpoint thereof.

19. The vacuum cleaner system of claim 18, wherein a spring is operably associated with said coupling member for biasing at least one of said first and second switch actuator elements into a position protruding from said housing.

20. The vacuum cleaner system of claim 19, wherein said spring comprises a torsion spring disposed at said midpoint of said coupling arm.

21. A tool comprising:

a housing having a graspable portion;

an upright handle secured to said housing for movement relative to said housing;

a switch disposed within said housing for turning on a motor of said tool;

a first switch actuator component located on said housing and adapted to be engaged with a single hand of a user for controlling said switch; and a second switch actuator component located on said housing and adapted to be engaged with a foot of a user independently of said first switch actuator component for controlling said switch.

22. A tool comprising:

a housing having a graspable portion;

a motor disposed within said housing;

a fan disposed within said housing and driven by said motor for generating a working airflow within said housing that can be used to perform a cleaning task;

a switch disposed within said housing adjacent said motor for controlling the application of electrical current to said motor, to thereby control on and off operation of said motor;

a first switch actuator component located on said housing adjacent said motor and adapted to be engaged with a single hand of a user, said first switch actuator component operating to control said switch; and a second switch actuator component located on said housing adjacent said motor and adapted to be controlled with only a foot of said user, to thereby control said switch.

* * * * *